US010118172B2

(12) United States Patent
Shim et al.

(10) Patent No.: US 10,118,172 B2
(45) Date of Patent: Nov. 6, 2018

(54) FLUID ANALYSIS CARTRIDGE AND FLUID ANALYSIS APPARATUS HAVING THE SAME

(71) Applicant: SAMSUNG ELECTRONICS CO., LTD., Suwon-si (KR)

(72) Inventors: Jeo Young Shim, Yongin-si (KR); Jong Myeon Park, Seongnam-si (KR); Jae Sung Lee, Suwon-si (KR); Do Gyoon Kim, Seongnam-si (KR); Young Seop Seong, Ansan-si (KR); Yeong Bae Yeo, Seoul (KR); Hae Seok Lee, Yongin-si (KR); Kyu Youn Hwang, Sejong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/362,953

(22) Filed: Nov. 29, 2016

(65) Prior Publication Data

US 2017/0189905 A1 Jul. 6, 2017

(30) Foreign Application Priority Data

Jan. 6, 2016 (KR) ..... 10-2016-0001319

(51) Int. Cl.
*B01L 3/00* (2006.01)

(52) U.S. Cl.
CPC ... *B01L 3/502715* (2013.01); *B01L 2200/143* (2013.01); *B01L 2200/16* (2013.01); *B01L 2300/021* (2013.01); *B01L 2300/0663* (2013.01); *B01L 2300/0864* (2013.01); *B01L 2300/168* (2013.01)

(58) Field of Classification Search
CPC ..... G01N 21/274; G01N 2021/0325; G01N 21/03; G01N 21/78; G01N 2201/121; G01N 2203/0647; B01L 2200/143; B01L 2300/0832; B01L 2300/0858; B01L 3/5082; B01L 3/5453; B01L 3/502715; G01B 11/08; G01B 11/12; G01B 11/24; G01F 23/292
See application file for complete search history.

(56) References Cited

U.S. PATENT DOCUMENTS 4,953,975 A * 9/1990 Levine ..... B01L 3/50215 356/246
6,980,285 B1 * 12/2005 Hansen ..... G01J 3/28 356/319

(Continued)

FOREIGN PATENT DOCUMENTS

WO 2005/086744 A2 9/2005

OTHER PUBLICATIONS

Lampien et al. (Thermofisher Scientific White pages 2012 p. 1-7).*

*Primary Examiner* — Sally A Merkling
(74) *Attorney, Agent, or Firm* — Sughrue Mion, PLLC

(57) ABSTRACT

A fluid analysis cartridge includes a reference well including a macromolecular coloring reagent having an optical characteristic that varies according to a thickness of the reference well, and a test well including a test reagent having an optical characteristic that varies according to a concentration of a component of a fluid sample that reacts with the test reagent and a thickness of the test well.

19 Claims, 15 Drawing Sheets

(56) References Cited

U.S. PATENT DOCUMENTS

| | | | | |
|---|---|---|---|---|
| 7,889,615 | B2 * | 2/2011 | Worthington | B01L 3/502715<br>369/100 |
| 2005/0227370 | A1 * | 10/2005 | Ramel | C12Q 1/00<br>436/514 |
| 2013/0337574 | A1 * | 12/2013 | Stefan | G01B 11/08<br>436/164 |

* cited by examiner (a)

(b)

FLUID ANALYSIS CARTRIDGE AND FLUID ANALYSIS APPARATUS HAVING THE SAME

CROSS-REFERENCE TO RELATED APPLICATION

This application claims priority to Korean Patent Application No. 10-2016-0001319, filed on Jan. 6, 2016 in the Korean Intellectual Property Office, the disclosure of which is incorporated herein by reference in its entirety.

BACKGROUND

1. Technical Field

Exemplary embodiments of the present disclosure relate to a fluid analysis cartridge and a fluid analysis apparatus having the same.

2. Description of the Related Art

In the field of environment monitoring, food examination, and medical diagnosis, an apparatus and a method for analyzing fluid samples are needed. Generally, a skilled tester manually performs various steps a number of times, such as injecting, mixing, separating, moving, reacting, and centrifuging of a reagent to test fluid samples according to a predetermined protocol. However, such a large number of manual operations may cause errors in the test results.

In order to improve said problem, there have been developments on miniature and automated apparatuses for rapidly analyzing test material. In particular, a portable fluid analysis cartridge analyzes fluid samples rapidly, and therefore, is capable of various functions in various fields and has an improved structure and function. In addition, the portable fluid analysis cartridge may be easily used by an unskilled person as well.

Meanwhile, a single fluid analysis cartridge may include a plurality of wells accommodating various reagents that react to fluid samples. However, when the fluid analysis cartridges are provided in bulk in a production process, even if the fluid analysis cartridges accommodate the same reagents, the absorbance of the reagent may be different from one fluid analysis cartridge to another fluid analysis cartridge depending on the thickness of a well of the fluid analysis cartridge.

SUMMARY

It is an aspect of the one or more exemplary embodiments to provide a fluid analysis cartridge accommodating material representing thickness information of a well so that the fluid analysis cartridge estimates the thickness of the well.

It is another aspect of the one or more exemplary embodiments to provide a fluid analysis cartridge accommodating material having sensitivity to a thickness of a well regardless of an inflow of a fluid sample.

It is another aspect of the one or more exemplary embodiments to provide a fluid analysis cartridge configured to determine the thickness of a well by measuring the light absorbance of a reference well accommodating material representing thickness information of a well and to analyze a fluid sample based on the determined thickness of the well.

According to an aspect of an exemplary embodiment, there is provided a fluid analysis cartridge including: a reference well including a macromolecular coloring reagent having an optical characteristic that varies according to a thickness of the reference well; and a test well including a test reagent having an optical characteristic that varies according to a concentration of a component of a fluid sample that reacts with the test reagent and a thickness of the test well.

The optical characteristic of the macromolecular coloring reagent may include a light absorbance.

The macromolecular coloring reagent may include macromolecular material and a coloring reagent which has sensitivity to the thickness of the reference well.

The macromolecular material may include at least one selected from the group consisting of phenyl vinyl ketone (PVK) and poly vinyl chloride (PVC).

The coloring reagent may include at least one selected from the group consisting of pyrene, acridine, methylene blue, acridine-orange, texas red, cyanine, and azo compound, the cyanine including cy3 and cy5.

The fluid analysis cartridge may further include a tag including information about at least one of a component and a concentration of the macromolecular coloring reagent included in the reference well.

The tag includes at least one of a Quick Response (QR) code, a bar code, and a radio frequency identification (RFID) tag.

The fluid analysis cartridge may further include a holder configured to support the fluid analysis cartridge.

The tag may be installed on a rear side of the holder, the rear side being opposite to a side at which the fluid sample is supplied to the test well.

The fluid analysis cartridge may further include a first sheet, a second sheet, and a third sheet, wherein the first sheet and the third sheet are formed of the same material.

An area of the first sheet corresponding to the reference well and another area of the first sheet corresponding to the test well may be transparent.

The macromolecular coloring reagent may be accommodated in an area of the second sheet corresponding to the reference well, and the test reagent for testing the fluid sample may be accommodated in another area of the second sheet corresponding to the test well.

The first sheet and the third sheet may each include at least one of a polyethylene (PE) film, a polypropylene (PP) film, a polyvinyl chloride (PVC) film, a polyvinyl alcohol (PVA) film, a polystyrene (PS) film, a polyethylene terephthalate (PET) film, and a urethane film, wherein the polyethylene film may include at least one of Very Low Density Polyethylene (VLDPE), Linear Low Density Polyethylene (LLDPE), Low Density Polyethylene (LDPE), Medium Density Polyethylene (MDPE), and High Density Polyethylene (HDPE).

The second sheet may be a porous sheet.

The second sheet may include at least one of cellulose acetate, Nylon 6.6, Nylon 6.10, polyethersulfone, poly tetrafluoro ethylene (PTFE), poly vinylidene fluoride (PVDF), and polyurethane.

According to an aspect of another exemplary embodiment, there is provided a fluid analysis apparatus including: a fluid analysis cartridge configured to accommodate a fluid sample; and a mounting member configured to mount the fluid analysis cartridge mounted to the fluid analysis apparatus, wherein the fluid analysis cartridge includes: a reference well including a macromolecular coloring reagent having an optical characteristic that varies according to a thickness of the reference well, and a test well including a test reagent having an optical characteristic that varies according to a concentration of a component included in the fluid sample that reacts with the test reagent and a thickness of the test well.

The fluid analysis apparatus may further include a light absorbance analysis module configured to measure a light absorbance of the reference well and a light absorbance of the test well when light is transmitted through the reference well and the test well.

The fluid analysis apparatus may further include a controller configured to determine the thickness of the reference well based on the light absorbance of the reference well.

The controller may be further configured to correct the light absorbance of the test well based on the determined thickness of the reference well.

The macromolecular coloring reagent may include macromolecular material and a coloring reagent which has sensitivity to the thickness of the reference well.

Additional aspects of the exemplary embodiments will be set forth in part in the description which follows and, in part, will be obvious from the description, or may be learned by practice of the exemplary embodiments.

BRIEF DESCRIPTION OF THE DRAWINGS

The above and/or other aspects of the disclosure will become apparent and more readily appreciated from the following description of exemplary embodiments, taken in conjunction with the accompanying drawings in which.

DETAILED DESCRIPTION

Figure 1:
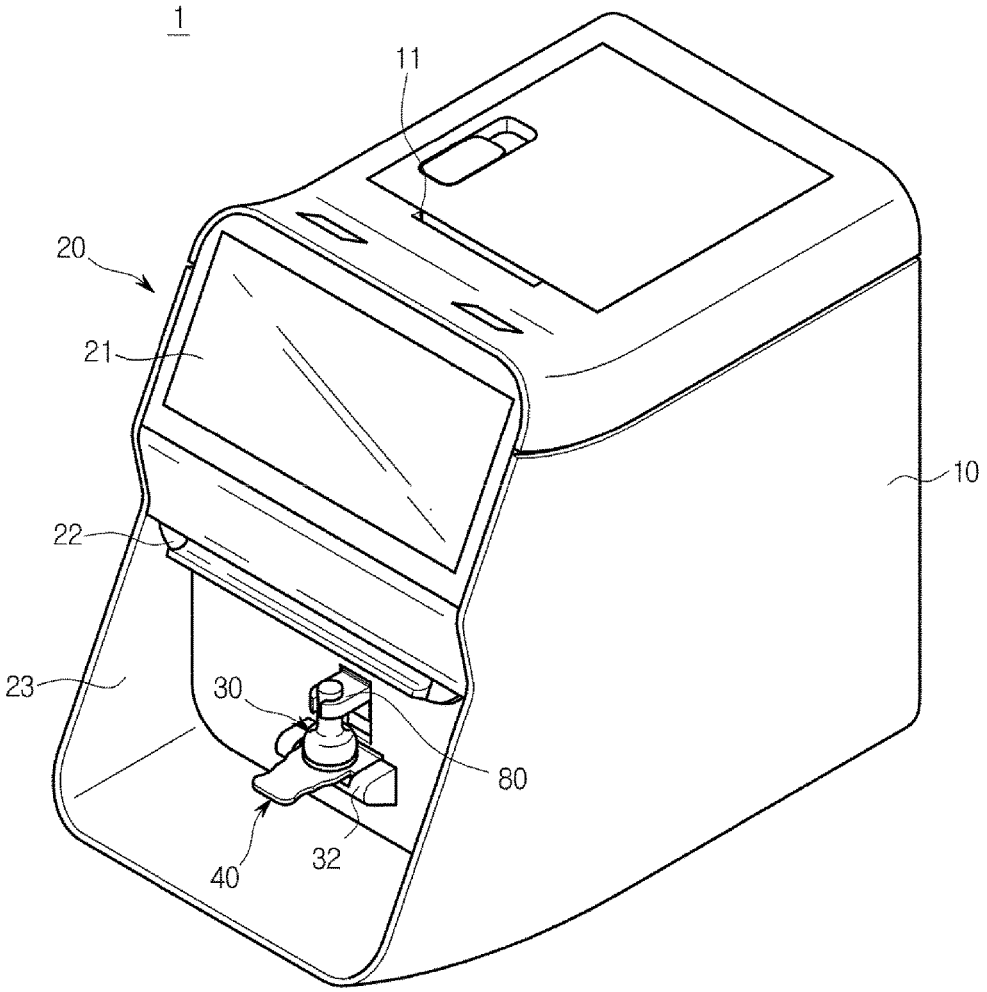
FIG. 1 is a perspective view illustrating an external appearance of a fluid analysis apparatus according to an exemplary embodiment.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, descriptions of well-known functions and constructions may be omitted for increased clarity and conciseness.

Additionally, exemplary embodiments will now be described more fully hereinafter with reference to the accompanying drawings. The exemplary embodiments may, however, be embodied in many different forms and should not be construed as being limited to the exemplary embodiments set forth herein. These exemplary embodiments are provided so that this disclosure will be thorough and complete and will fully convey the exemplary embodiments to those of ordinary skill in the art. Like numerals denote like elements throughout.

It will be understood that, although the terms first, second, etc., may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, the element can be directly connected or coupled to the other element or intervening elements may be present. In contrast, when an element is referred to as being "directly connected," or "directly coupled," to another element, there are no intervening elements present.

The terminology used herein is for the purpose of describing particular exemplary embodiments only and is not intended to be limiting. As used herein, the singular forms "a," "an," and "the," are intended to include the plural forms as well, unless the context clearly indicates otherwise. Further, spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures.

Reference will now be made in detail to the exemplary embodiments of the present disclosure, examples of which are illustrated in the accompanying drawings, wherein like reference numerals refer to like elements throughout.

FIG. 1 is a perspective view illustrating an external appearance of a fluid analysis apparatus according to an exemplary embodiment.

Referring to FIG. 1, a fluid analysis apparatus 1 according to an exemplary embodiment may include a case 10 which forms the outer appearance of the fluid analysis apparatus 1 and a door module 20 installed on the front side of the case 10.

The door module 20 may include a display 21, a door 22, and a door frame 23. The display 21 and the door 22 may be arranged at the front of the door frame 23. The display 21 may be located at the upper portion of the door 22. The door 22 may be configured to be slidable. When the door 22 is opened by sliding, the door 22 may be configured to be located at the rear of the display 21.

The display 21 may display information about results of a sample analysis and operational status of the sample analysis, etc. The door frame 23 may be provided with a mounting member 32 on which a fluid analysis cartridge 40 configured to accommodate a fluid sample is mounted. A user may open the door 22 by sliding the door 22 upward, mount a fluid analysis cartridge 40 on the mounting member 32, and close the door 22 by sliding the door 22 downward and then allow the fluid analysis apparatus 1 to perform an analysis operation.

The fluid analysis apparatus 1 may further include the fluid analysis cartridge 40.

The fluid analysis cartridge 40 may be detachably coupled to the fluid analysis apparatus 1.

When the fluid sample is injected into the fluid analysis cartridge 40, the fluid sample reacts with a reagent of a tester 45. The fluid analysis cartridge 40 may be inserted into the mounting member 32, and a pressurizing member 30 may pressurize the fluid analysis cartridge 40 so that the fluid sample in the fluid analysis cartridge 40 may flow into the tester 45. The pressurizing member 30 may be coupled to a lever 80 of the fluid analysis apparatus 1.

The fluid analysis apparatus 1 may further include a printer 11 configured to print out the results of the sample analysis.

The fluid analysis apparatus 1 may further include a pressurizing member 30. The pressurizing member 30 may move the fluid sample to the tester 45 by pressurizing the fluid sample. In other words, the pressurizing member 30 serves to move the fluid sample to the tester 45 by applying a pressure to the fluid sample.

The pressurizing member 30 may be arranged to pressurize the fluid analysis cartridge 40. Specifically, the pressurizing member 30 may be arranged to pressurize a fluid supplier 42 (see FIG. 2). The pressurizing member 30 may be arranged to pressurize the fluid supplier 42 such that a fluid sample supplied to the fluid supplier 42 is moved to the tester 45. The pressurizing member 30 may pressurize the fluid supplier 42 by moving upward and downward. In other words, the pressurizing member 30 may pressurize the fluid supplier 42 using the principle of leverage. The pressurizing member 30 may be coupled to the lever 80. The lever 80 may be combined to a shaft installed in the fluid analysis apparatus 1 so as to move upward and downward. Accordingly, the pressurizing member 30 coupled to the lever 80 may move upward and downward together with the lever 80.

The pressurizing member 30 may include at least one of elastic material and ductile material. For an example, the pressurizing member 30 may be formed of rubber.

Figure 2:
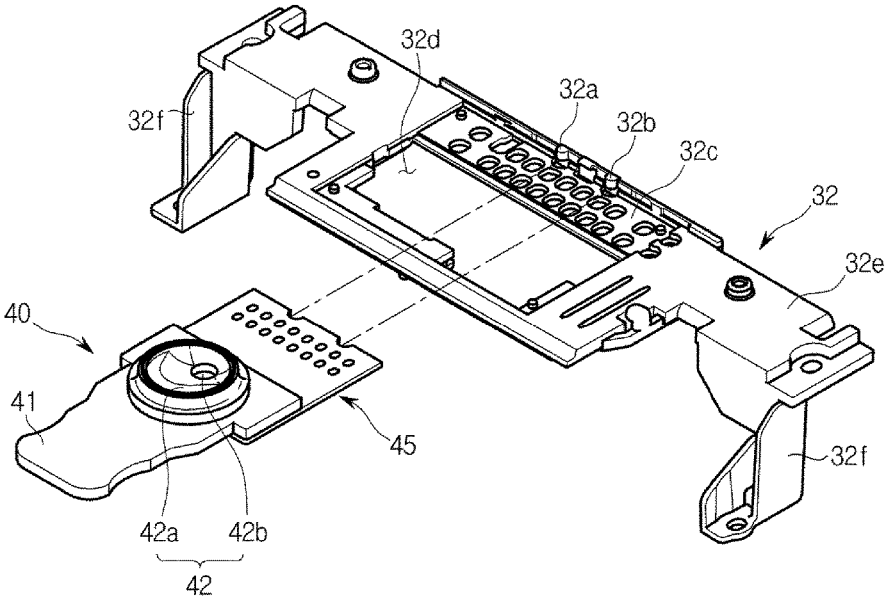
FIG. 2 is a perspective view illustrating a mounting member and a fluid analysis cartridge of a fluid analysis apparatus which are disassembled.
Figure 3:
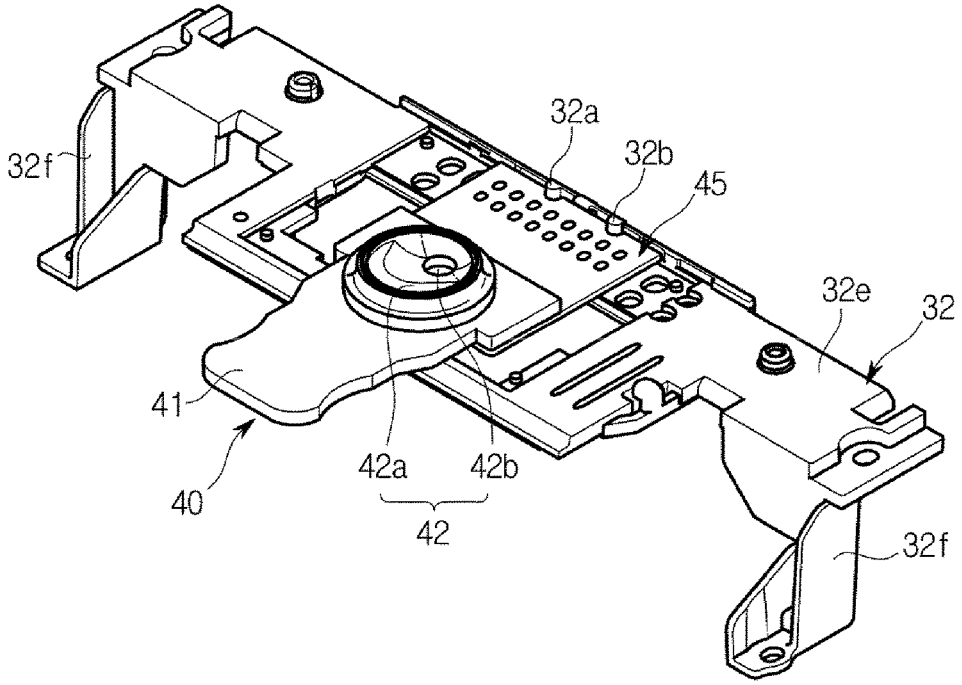
FIG. 3 is a perspective view illustrating a mounting member and a fluid analysis cartridge of a fluid analysis apparatus which are assembled.
Figure 4:
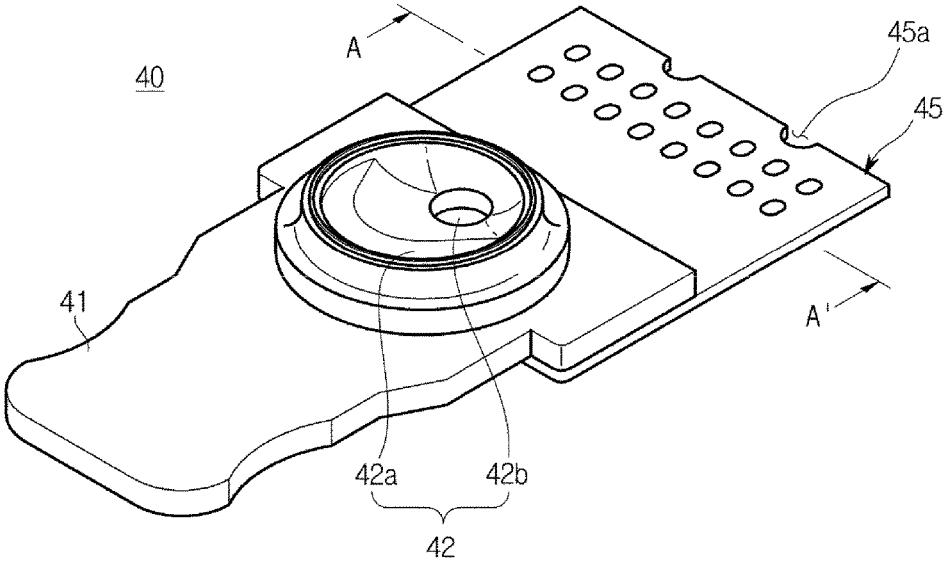
FIG. 4 is a perspective view illustrating a fluid analysis cartridge according to an exemplary embodiment.

FIG. 2 is a perspective view illustrating a mounting member and a fluid analysis cartridge of a fluid analysis apparatus which are disassembled, FIG. 3 is a perspective view illustrating a mounting member and a fluid analysis cartridge of a fluid analysis apparatus which are assembled, and FIG. 4 is a perspective view illustrating a fluid analysis cartridge according to an exemplary embodiment.

Referring to FIGS. 2 to 4, the fluid analysis cartridge 40 may be inserted into the mounting member 32 of the fluid analysis apparatus 1. The mounting member 32 may include a seat 32*c* on which the fluid analysis cartridge 40 is seated and a supporter 32*f* supporting the mounting member 32 in the fluid analysis apparatus 1. The supporter 32*f* may be extended from both sides of a body 32*e* of the mounting member 32 and the seat 32*c* may be arranged in the middle of the body 32*e*. A slit 32*d* may be arranged at a rear side of the seat 32*c*. The slit 32*d* may be arranged to prevent an error from occurring when the fluid sample of the tester 45 is analyzed.

The mounting member 32 may include contacts 32*a* and 32*b* which make contact with the fluid analysis cartridge 40, and the tester 45 of the fluid analysis cartridge 40 may include recesses 45*a* which have shapes corresponding to the shapes of the contacts 32*a* and 32*b*. The recesses 45*a* may contact with the contacts 32*a* and 32*b*. The fluid analysis cartridge 40 may include two recesses 45*a* and two contacts 32*a* and 32*b*, but the number of the recesses 45*a* and the contacts 32*a* and 32*b* is not limited thereto.

The fluid analysis cartridge 40 may include a housing 41 forming the exterior of the fluid analysis cartridge 40 and the tester 45 in which the fluid sample and the reagent are combined and a reaction occurs.

The housing 41 may support the fluid analysis cartridge 40. Further, the housing 41 may include a holder so that the user may hold the fluid analysis cartridge 40. The holder may be formed in a streamlined shape so that the user stably holds the fluid analysis cartridge 40.

Further, the fluid analysis cartridge 40 may include a fluid supplier 42 to supply the fluid sample. Specifically, the fluid supplier 42 may be arranged at the housing 41. The fluid supplier 42 may include a supply hole 42*b* through which the fluid sample is introduced into the tester 45 and a supply assistant 42*a* which assists a supply of the fluid sample. The fluid sample configured to be tested by the fluid analysis apparatus 1 may be supplied to the fluid supplier 42, and the fluid sample may include a bio sample such as body fluid, saliva, and urine including blood, tissue fluid, and lymph, etc. or an environmental sample for managing water-purity control or soil control, but the fluid sample is not limited thereto.

The supply hole 42*b* may be formed in a round shape, but is not limited thereto, and may also be formed in a polygonal shape. The user may drop the fluid sample to the fluid supplier 42 using a tool such as a pipette or a syringe. The supply assistant 42*a* may be formed around the supply hole 42*b* to be inclined toward the supply hole 42*b*. Thereby the fluid sample dropped around the supply hole 42*b* may flow into the supply hole 42*b* along the inclination of the supply assistant 42*a*. Specifically, when a user fails to precisely drop the fluid into the supply hole 42*a* and some of the fluid sample is dropped around the supply hole 42*a*, the fluid sample may be introduced into the supply hole by the inclination of the supply assistant 42*a*.

Further, the supply assistant 42*a* not only assists the supply of the fluid sample but also prevents contamination of the fluid analysis cartridge 40 by a fault supply of the fluid sample. Specifically, even though the fluid sample does not flow into the exact position of the supply hole 42*b*, the contamination of the fluid analysis cartridge 40 by the fluid sample may be prevented since the supply assistant 42*a* around the supply hole 42*b* prevents the fluid sample from flowing to the tester 45 or the holder. In addition, the supply assistant 42*a* may prevent the user from contacting the fluid sample which is harmful to the human body.

The fluid supplier 42 may include at least one supply hole 42*b*. When the fluid supplier 42 includes a plurality of supply holes 42*b*, tests may be simultaneously performed on the plurality of fluid samples which are different from each other in one fluid analysis cartridge 40. Herein, the fluid samples may have the same type but may be originated from different manufacturers, may have different types and different origins, or may have the same type and same origin but different statuses.

The housing 41 may have a shape configured to implement a predetermined function, and may include various materials which may be easily shaped and are not activated by chemicals or biological materials. For example, the housing 41 may include acrylic such as Polymethyl Methacrylate (PMMA), Polysiloxane such as Polydimethylsiloxane (PDMS), Polycarbonate (PC), Polyethylene such as Linear Low Density Polyethylene (LLDPE), Low Density Polyethylene (LDPE), Medium Density Polyethylene (MDPE), and High Density Polyethylene (HDPE), plastic material such as Polyvinyl alcohol, Very Low Density Polyethylene (VLDPE), Polypropylene (PP), Acrylonitrile butadiene styrene (ABS), and Cyclic olefin copolymer (COC), glass, mica, silica, a semiconductor wafer. The above-mentioned materials are only examples, and exemplary embodiments are not limited thereto. For example, the material forming the housing 41 is not limited to any particular material as long as the material has chemical and biological stability and mechanical processability.

The fluid analysis cartridge 40 may be configured to be coupled to or bonded to the tester 45. In other words, the tester 45 may be coupled to or bonded to the housing 41. The test may be performed when a fluid sample flows into the tester 45 through the fluid supplier 42 and a reagent reacts with the fluid sample in the tester 45. The tester 45 may include a test portion 47*b*, and the test portion 47*b* accommodates a reagent reacting to the fluid sample or a coloring reagent according to an exemplary embodiment. The coloring reagent according to an exemplary embodiment will be described in detail later.

Figure 5:
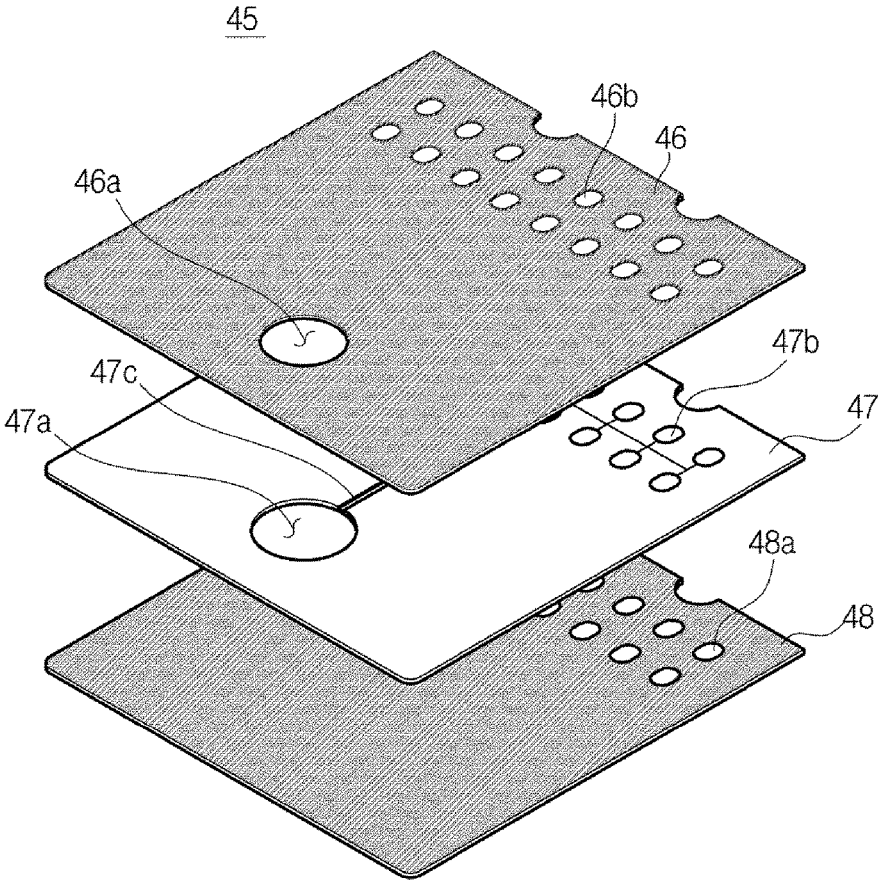
FIG. 5 is a view illustrating a disassembled tester of a fluid analysis cartridge according to an exemplary embodiment.

FIG. 5 is a view illustrating a disassembled tester of a fluid analysis cartridge according to an exemplary embodiment.

As illustrated in FIG. 5, the tester 45 of the fluid analysis cartridge 40 may be formed in a structure having three sheets bonded to each other. The three sheets may include a first sheet 46, a second sheet 47, and a third sheet 48. The first sheet 46 and the third sheet 48 may be printed with light blocking ink so that the fluid sample moving to the test portion 47*b* is protected from the light outside or may prevent an error from occurring when optical characteristics are measured in the test portion 47*b*. In addition, the first sheet 46 and the third sheet 48 may be coated with a light blocking film so that the fluid sample moving to the test portion 47*b* is protected from the light outside or may prevent an error from occurring when optical characteristics are measured in the test portion 47*b*. The light blocking film may include carbon. The first sheet 46, the second sheet 47, and the third sheet 48 may be integrally formed with each other.

Films used to form the first sheet 46 and the third sheet 48 of the tester 45 may include material selected among at least one of a Polyethylene film such as Very Low Density Polyethylene (VLDPE), Linear Low Density Polyethylene (LLDPE), Low Density Polyethylene (LDPE), Medium Density Polyethylene (MDPE), and High Density Polyethylene (HDPE), a Polypropylene (PP) film, a Polyvinyl Chloride (PVC) film, a Polyvinyl Alcohol (PVA) film, a Polystyrene (PS) film, a Polyethylene Terephthalate (PET) film, and a urethane film. However, the above-mentioned films are only examples, and the films forming the first sheet 46 and 48 are not limited to these examples as long as the films are chemically and biologically inactivate and mechanically processible. The first sheet 46 and the third sheet 48, for example, may be referred to as PAT sheets.

The second sheet 47 of the tester 45 may be formed of a porous sheet unlike the first sheet 46 and the third sheet 48. The porous sheet used as the second sheet 47 may include at least one of Cellulose acetate, Nylon 6.6, Nylon 6.10, Polyethersulfone, Poly Tetrafluoro Ethylene (PTFE), Poly Vinylidene Fluoride (PVDF), and Polyurethane. As the second sheet 47 is formed of the porous sheet, the second sheet 47 serves as a vent and enables the fluid sample to move inside the tester 45 without any driving sources. In addition, the second sheet 47 may be coated with a hydrophobic solution to prevent the fluid sample which may have a hydrophile property from permeating into the second sheet 47. The second sheet 47 for example may be referred to as a Space sheet.

The first sheet 46, the second sheet 47, and the third sheet 48 may have a layer structure.

The first sheet 46 may be arranged at a lower side of the fluid supplier 42. In other words, the first sheet 46 may be adjacent to the fluid supplier 42. The second sheet 47 may be arranged to face the first sheet 46. The third sheet 48 may be arranged to be opposed to the first sheet 46 while interposing the second sheet 47 therebetween.

A first inflow portion 46*a* through which the fluid sample is introduced may be formed at the first sheet 46, and an area 46*b* of the first sheet corresponding to the test portion 47*b* may be transparent and have a light penetration characteristic. An area 48*a* of the third sheet 48 corresponding to the test portion 47*b* may also be transparent so that the light absorbance of a reaction occurring in the test portion 47*b*, that is, optical characteristics may be measured.

A second inflow portion 47*a* through which the fluid sample is introduced may also be formed at the second sheet 47, and the fluid sample may reach the tester 45 through the first inflow portion 46*a* and the second inflow portion 47*a*. The first inflow portion 46*a* may have a width smaller than that of the second inflow portion 47*a*. Various reactions may occur in the tester 45 to analyze the fluid sample. When the fluid sample is blood, the test portion 47*b* accommodates a reagent which develops or changes its color by reacting with a certain component of the blood, specifically blood plasma, so that the color developed in the test portion 47*b* is detected optically and quantified. A result value quantified as the above is referred to as "light absorbance" and a user may check an existence of a certain component in the blood or a proportion of the certain component by using the light absorbance.

Further, a flow channel 47*c* connecting the second inflow portion 47*a* to the test portion 47*b* may be formed at the second sheet 47.

The area 46*b* of the first sheet 46 corresponding to the test portion 47*b*, the test portion 47*b* of the second sheet 47, and the area 48*a* of the third sheet 48 corresponding to the test portion 47*b* may form a single well. The fluid analysis apparatus 1 may check an existence of a certain component or a proportion of the certain component by using each light absorbance of a plurality of wells w (see FIG. 7) included in a single tester 45.

The first sheet 46, the second sheet 47, and the third sheet 48 may be combined with each other by double-sided tapes. In detail, the first sheet 46, the second sheet 47, and the third sheet 48 may be combined with each other by double-sided tapes which are attached at the upper side and at the back side of the second sheet 47, respectively.

An exemplary embodiment, using the first sheet 46 and the third sheet 48 having Polyethylene Terephthalate (PET) material coated with carbon and the second sheet 47 having Cellulose Acetate material, will be described as follows.

Figure 6:
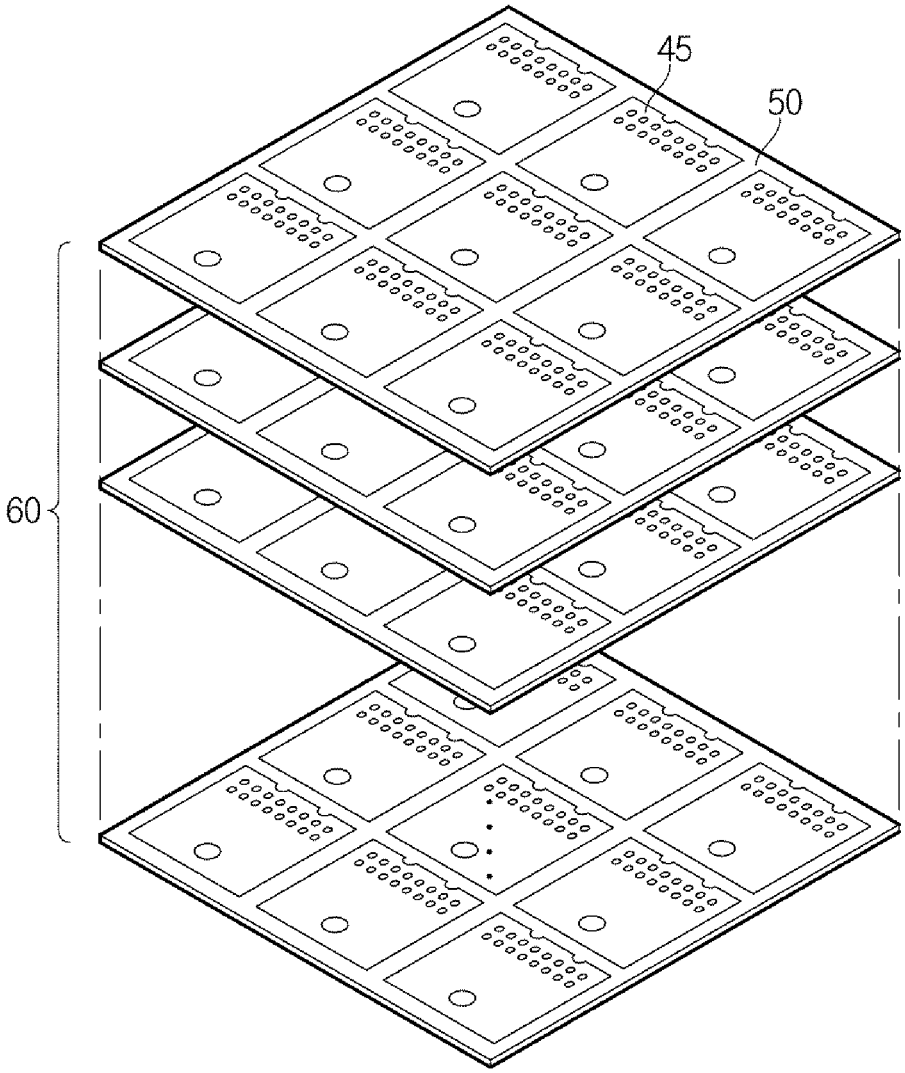
FIG. 6 is a view for describing a process of producing a tester of a fluid analysis cartridge.
Figure 7:
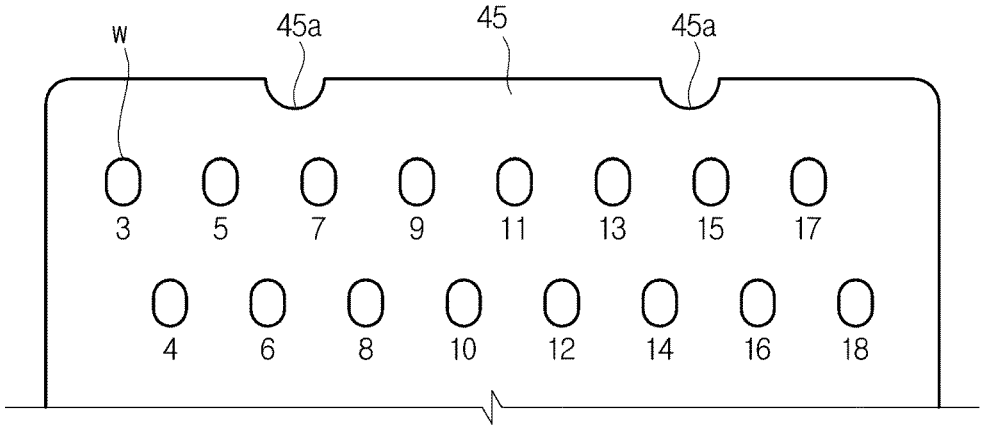
FIG. 7 is a plane view illustrating a tester of a fluid analysis cartridge including a plurality of wells.
Figure 8:
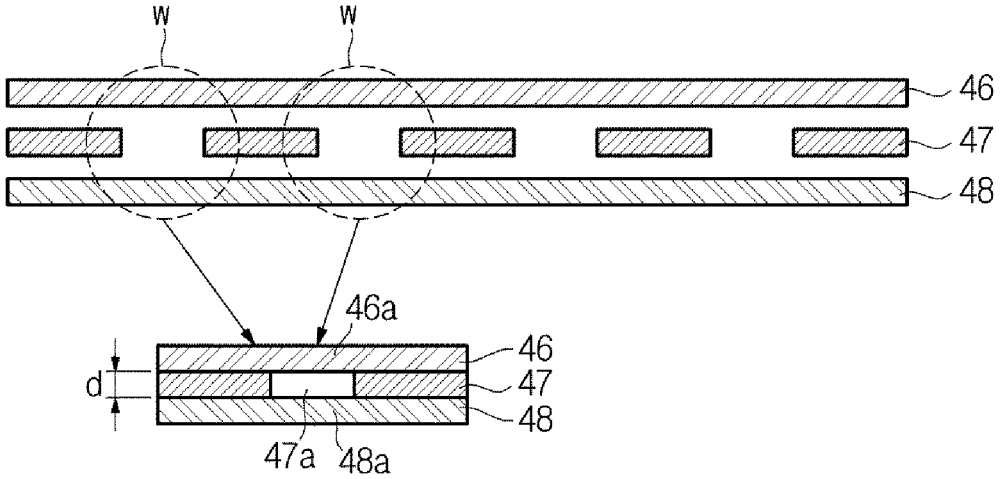
FIG. 8 is a cross-sectional view taken along line A-A' a tester of a fluid analysis cartridge shown in FIG. 4.

FIG. 6 is a view for describing a process of producing a tester of a fluid analysis cartridge, FIG. 7 is a plane view illustrating a tester of a fluid analysis cartridge including a plurality of wells, and FIG. 8 is a cross-sectional view taken along line A-A' a tester of a fluid analysis cartridge shown in FIG. 4.

In the production process, a plurality of sheets are produced in one lot 60 so that a large quantity of the testers 45 of the fluid analysis cartridge 40 are produced in a short time. In this case, a plurality of the testers 45 are included in one sheet, and the production process produces the plurality of the testers 45 by cutting the produced sheets in units of testers 45.

However, when the production process produces a plurality of same sheets 50 in one lot 60, sheets 50 which have unequal thicknesses may be produced actually due to environmental differences between operators or production facilities in the production process, and the thicknesses of the testers 45 may be unequal as well.

Specifically, referring to FIGS. 7 and 8, one tester 45 may include a plurality of wells w, and each of the wells w includes the area 46*b* of the first sheet 46 corresponding to the test portion 47*b*, the test portion 47*b* of the second sheet 47, and the area 48*a* of the third sheet 48 corresponding to the test portion 47*b* as illustrated in FIG. 8.

The test portion 47*b* of the second sheet 47 may accommodate a test reagent responsive to the fluid sample or a macromolecular coloring reagent according to an exemplary embodiment, and the thickness d of the test portion 47*b* may differ depending on the thickness of the second sheet 47. For example, the thickness of the test portion 47*b* may be 1 mm.

Meanwhile, when two testers 45 accommodate the same reagents in the same wells w (for example, the third well (3)) and the same fluid samples flow into each tester 45, the same light absorbance A should be detected from the two testers 45 since the same fluid samples are accommodated in the wells which have the same reagents and the same thickness.

However, referring to Equation (1) below which is related to the Lambert-Beer law, the light absorbance of the well w of each tester 45 actually differs from each other as the thickness d of the test portion 47*b* of each tester 45 differs from each other.

$$A=\varepsilon*d*c \quad (1)$$

where A is the light absorbance, ε is a molar extinction coefficient, d is the thickness of the test portion 47*b*, and *c* is molarity of material filled in the test portion 47*b*. Accordingly, the fluid analysis apparatus 1 may need to correct the light absorbance detected from each tester 45 such that the two testers 45 have the same light absorbance, and may need to analyze the fluid sample introduced into the tester 45 based on the corrected light absorbance.

Meanwhile, the fluid analysis apparatus 1 has difficulty identifying the thickness d of the test portion 47*b* in advance, so when the tester 45 is installed at the mounting member 32, the fluid analysis apparatus 1 may need to perform a process of determining the thicknesses of the wells w included in the tester 45 (specifically, the thicknesses d of the test portions 47*b*).

The fluid analysis cartridge 40 according to an exemplary embodiment includes at least one well, that is, a reference well $W_{ref}$ which includes material reflecting thickness information of the well w among the plurality of wells, so that the fluid analysis apparatus 1 may estimate the thicknesses of the wells w included in the tester 45 when analyzing the fluid sample.

Hereinafter, referring to FIGS. 9 to 14, the fluid analysis cartridge 40 according to an exemplary embodiment is described below.

Figure 9:
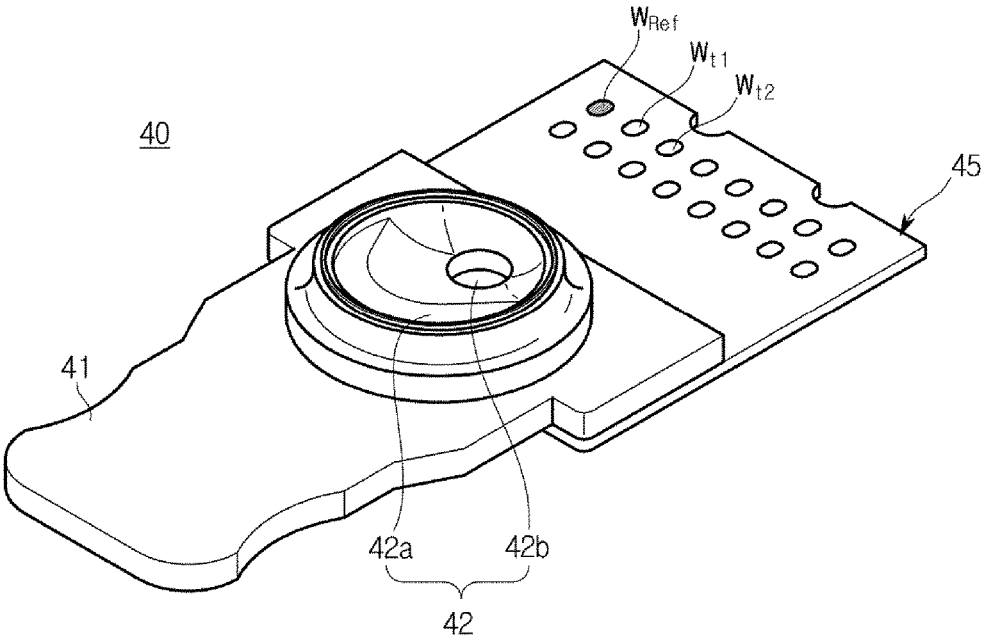
FIG. 9 is an illustration of a fluid analysis cartridge including a reference well and a test well according to an exemplary embodiment.
Figure 10:
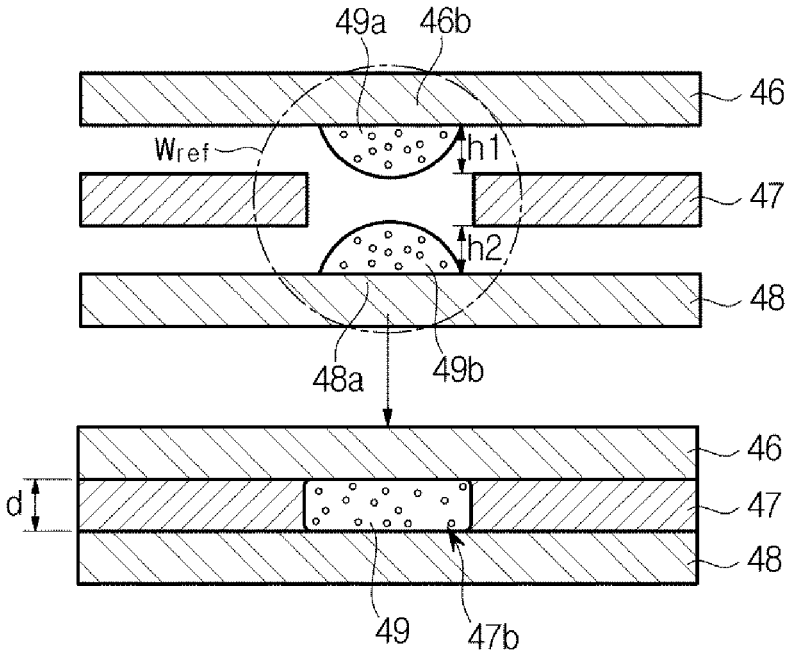
FIG. 10 is an enlarged view illustrating a reference well for describing a process of creating a reference well of a fluid analysis cartridge according to an exemplary embodiment.

FIG. 9 is an illustration of a fluid analysis cartridge including a reference well and a test well according to an exemplary embodiment, and FIG. 10 is an enlarged view illustrating a reference well for describing a process of creating a reference well of a fluid analysis cartridge according to an exemplary embodiment.

Referring to FIG. 9, the tester 45 of the fluid cartridge 40 according to an exemplary embodiment includes at least one reference well $W_{ref}$ and at least one test well $W_t$ ($W_{t1}$, $W_{t2}$).

In FIG. 9, the tester 45 is described to have one reference well $W_{ref}$ and fifteen test wells $W_t$, but the number of the reference wells $W_{ref}$ and the test wells $W_t$ is not limited as such.

The reference well $W_{ref}$ is used for the fluid analysis apparatus 1 to measure the thickness of the tester 45. The thickness of the reference well $W_{ref}$ of the tester 45 is assumed to be the same as the thickness of the test wells $W_t$.

Referring to FIG. 10, the reference well $W_{ref}$ includes an area 46*b* of the first sheet 46 corresponding to the test portion 47*b*, the test portion 47*b* of the second sheet 47, and an area 48*a* of the third sheet 48 corresponding to the test portion 47*b*, and further includes a macromolecular coloring reagent 49 which is filled in the test portion 47*b*.

The macromolecular coloring reagent 49 includes macromolecular material and a coloring reagent.

The macromolecular material may include material such as Phenyl Vinyl Ketone (PVK), and Poly Vinyl Chloride (PVC). However, the material of the macromolecular material is not limited as described above.

The macromolecular material may be formed of a mixture or a solid having viscosity. When the macromolecular material is combined with a coloring reagent, fewer gaps are formed compared to when the macromolecular material formed of liquid I is combined with a coloring reagent.

The macromolecular material may be water-soluble polymer material which is less reactive to the fluid sample compared with the liquid material.

The macromolecular coloring reagent 49, including the macromolecular material, may have a low sensitivity to the fluid sample and reflect information about the thickness of the reference well $W_{ref}$ regardless of components or concentrations of the fluid sample.

The coloring reagent shows different colors depending on the thickness of the reference well $W_{ref}$, specifically the thickness of the test portion 47*b*. That is, when the light is transmitted to the coloring reagent, the amount of light absorbed differs depending on the thickness of the test portion 47*b*, so that the coloring reagent reflects information about the thickness of the test portion 47*b*. In this case, the coloring reagent may absorb light in a visible ray wavelength range and in a ultraviolet wavelength range.

Therefore, by transmitting the light to the macromolecular coloring reagent 49 including the coloring reagent, and measuring the light absorbance of the macromolecular coloring reagent 49 to measure the amount of light absorbed, the fluid analysis apparatus 1 may estimate the thickness of the test portion 47*b* of the reference well $W_{ref}$.

The coloring reagent may include pyrene, acridine, methylene blue, acridine-orange, texas red, cyanine, and azo compound, and the cyanine may include cy3 and cy5. However, the material of the coloring reagent is not limited as described above.

In order to produce (e.g., manufacture) the reference well $W_{ref}$ according to an exemplary embodiment, the production process, as illustrated in FIG. 10, may allow the test portion 47*b* to be filled with the macromolecular coloring reagent 49 by applying a first macromolecular coloring reagent 49*a* on the bottom side of the area 46*b* of the first sheet 46 corresponding to the test portion 47*b*, applying a second macromolecular coloring reagent 49*b* on the upper side of the area 48*a* of the third sheet 48 corresponding to the test portion 47*b*, and combining the first sheet 46, the second sheet 47 and the third sheet 48 in a sandwich configuration.

The first macromolecular coloring reagent 49*a* and the second macromolecular coloring reagent 49*b* may be parts of the one macromolecular coloring reagent 49 having the same chemical component. On the other hand, the first macromolecular coloring reagent 49*a* and the second macromolecular coloring reagent 49*b* may have a different chemical component from each other and may come to have the same chemical component as the macromolecular coloring reagent 49 when combined with each other.

The applying quantity and the concentration of the first macromolecular coloring reagent 49*a* and the second macromolecular coloring reagent 49*b* may be the same or may be different from each other.

However, when the test portion 47*b* has a predetermined thickness d, the sum of application thickness h1 of the first macromolecular coloring reagent 49*a* and application thickness h2 of the second macromolecular coloring reagent 49*b* may need to be larger than or equal to the thickness d of the test portion 47*b*. Therefore, when the application thickness h1 of the first macromolecular coloring reagent 49*a* and the application thickness h2 of the second macromolecular coloring reagent 49*b* are equal, each application thickness h1, h2 may be selected to have a half of the thickness of the test portion 49*b* (d/2) or larger.

Other wells (test wells $W_t$) except the reference well $W_{ref}$ in the tester may accommodate a reagent to detect the concentration of glucose concentrations of the fluid sample, a reagent to detect the concentration of cholesterol, or a reagent to detect bad liver numbers such as GGT.

Hence, using the fluid analysis cartridge 40 including the reference well $W_{ref}$ and the test well $W_t$, the fluid analysis apparatus 1 may measure the absorbance of each of the reference well $W_{ref}$ and the test well $W_t$, and may correct the absorbance of the test well $W_t$ based on the thickness information of the tester 45 which may be inferred by measuring the absorbance of the reference well $W_{ref}$. A method for correcting the absorbance will be described later.

Meanwhile, the macromolecular coloring reagent 49 filled in the reference well $W_{ref}$ may have different absorbance according to a type and concentration of the coloring reagent.

Figure 11:
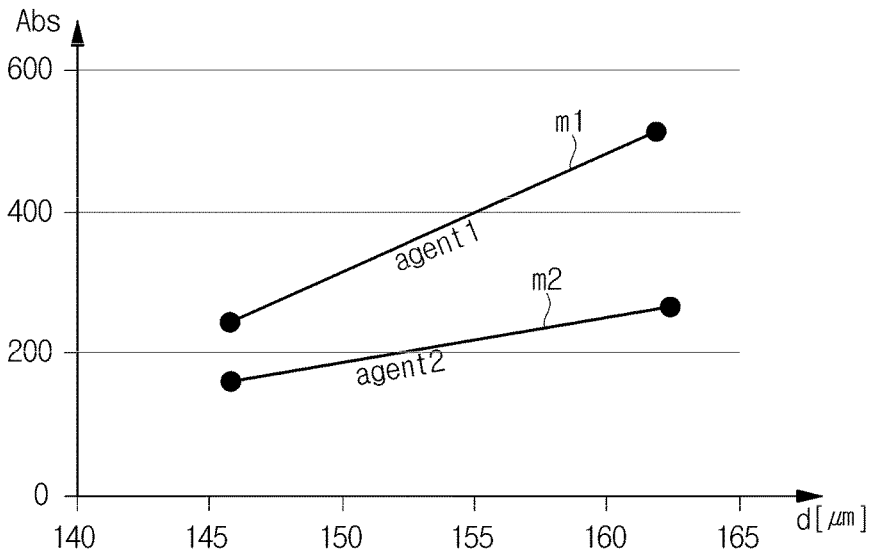
FIG. 11 is a graph showing light absorbance relative to thickness according to types or concentrations of coloring reagents.
Figure 12:
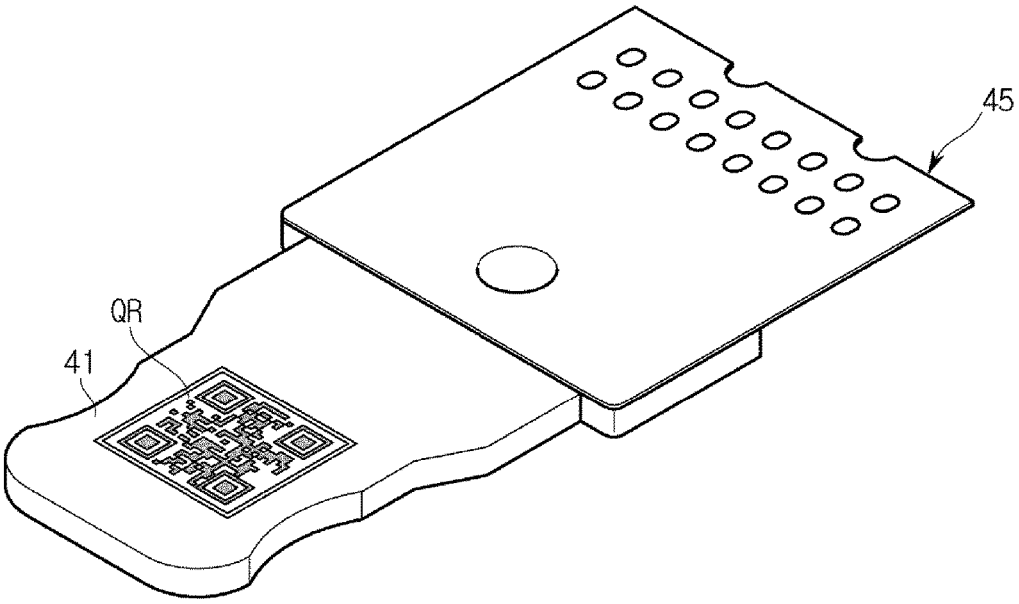
FIG. 12 is a rear side view illustrating a fluid analysis cartridge including a tag including information about a type or a concentration of a coloring reagent.

FIG. 11 is a graph showing light absorbance relative to thickness according to types or concentrations of the coloring reagents, and FIG. 12 is a rear side view illustrating a fluid analysis cartridge including a tag including information about a type or a concentration of a coloring reagent.

Referring to FIG. 11, when the macromolecular coloring reagent 49 filled in the reference well $W_{ref}$ includes a first coloring reagent (agent 1), the macromolecular coloring reagent 49 may have a slope m1 in the graph. When the reference well $W_{ref}$ includes a second coloring reagent (agent 2), the macromolecular coloring reagent 49 may have a slope m2 in the graph. Here, the slope m1 may represent the optical density (OD) of the first coloring reagent (agent 1) according to the Lambert-Beer Law, and the slope m2 may represent the optical density (OD) of the second coloring reagent (agent 2). The optical density may be expressed by ε*c in Equation (1) above.

In case the thickness d of the reference well $W_{ref}$ increases, when an absorbance variation of the first coloring reagent (agent 1) is greater than an absorbance variation of the second coloring reagent (agent 2) (that is, the slope m1 is greater than the slope m2), sensitivity to the thickness of the first coloring reagent (agent 1) is greater than that of the second coloring reagent (agent 2).

Herein, the first coloring reagent (agent 1) and the second coloring reagent (agent 2) may have a different component from each other, or have the same component but different concentrations from each other.

When the macromolecular coloring reagents 49 having the same component and the same concentration are injected into each test portion 47*b* of the fluid analysis cartridges 40 in the production process, the fluid analysis apparatus 1 may measure the absorbance of the reference well $W_{ref}$ without considering the component and the concentration of the coloring reagent, and may determine (or perform calibration of) the thickness d of the reference well $W_{ref}$ which corresponds to the light absorbance based on pre-stored sensitivity data for thickness.

For example, when the first coloring reagents (agent 1) having the same concentration are injected into the test portions 47*b* in the production process, the fluid analysis apparatus 1 may measure the light absorbance of the reference well $W_{ref}$ as being 400, and may determine the thickness d of the reference well $W_{ref}$ as being 155 um corresponding to the absorbance of 400 based on the slope data m1*a*.

However, when coloring reagents having a different component or a different concentration are injected into the test portions 47*b* in the production process, the fluid analysis apparatus 1 does not identify the component and the concentration of the coloring reagent, and therefore may not decide which data needs to be referenced among various pieces of pre-stored sensitivity data for thickness when determining the thickness d of the reference well $W_{ref}$.

Moreover, when coloring reagents to be injected in the production process need to have the same component and the concentration, the component and concentrations of coloring reagents produced in practice may be different between the testers 45 due to different production environments. In this case, even though the fluid analysis apparatus 1 determines the thickness d based on the pre-stored sensitivity data for the thickness, an error may occur unless considering the different components and concentrations.

Therefore, referring to FIG. 12, a fluid analysis apparatus 40 according to another exemplary embodiment may further include a tag QR which includes at least one of component information of the coloring reagent and concentration information of the coloring reagent.

At least one of the component and the concentration of the coloring reagent included in the tag QR may be additionally measured in the production process.

The tag QR may be configured as various types of storage media such as a bar code, a Quick Response (QR) code, a NFC tag, and a radio frequency identification (RFID) tag.

The tag QR is illustrated as being attached to the back of the fluid analysis cartridge 40 in FIG. 12 but the attaching position is not limited thereto. For example, the tag QR may be attached or installed at the front, side, inside, or other various positions of the fluid analysis cartridge 40.

When the fluid analysis cartridge 40 according to another exemplary embodiment includes the tag QR, the fluid analysis apparatus 1 may read the tag QR of the fluid analysis cartridge 40, and may decide which data needs to be referenced, for example, thickness sensitivity data regarding the second coloring reagent, among various pieces of pre-stored thickness sensitivity data to perform the calibration. Further, the fluid analysis apparatus 1 may determine the thickness d of the reference well$_{wref}$, which corresponds to the detected light absorbance, based on the decided thickness sensitivity data.

Meanwhile, although certain exemplary embodiments have been described in a case in which the sensitivity to the thickness of the macromolecular coloring reagent 49 varies according to the component and the concentration of "the coloring reagent," the sensitivity to the thickness of the macromolecular coloring reagent 49 may vary according to the component and concentration of the "macromolecular material" as well. In this case, the tag QR may include information about a type and concentration of the macromolecular material.

Although certain exemplary embodiments assume that the test portion 47*b* of the reference well $W_{ref}$ is connected to the test portions 47*b* of other test wells $W_t$ so a fluid sample may flow into the test portion 47*b* of the reference well $W_{ref}$, the test portion 47*b* of the reference well $W_{ref}$ may be configured to be disconnected from the test portions 47*b* of other test wells $W_t$ as well.

Figure 13:
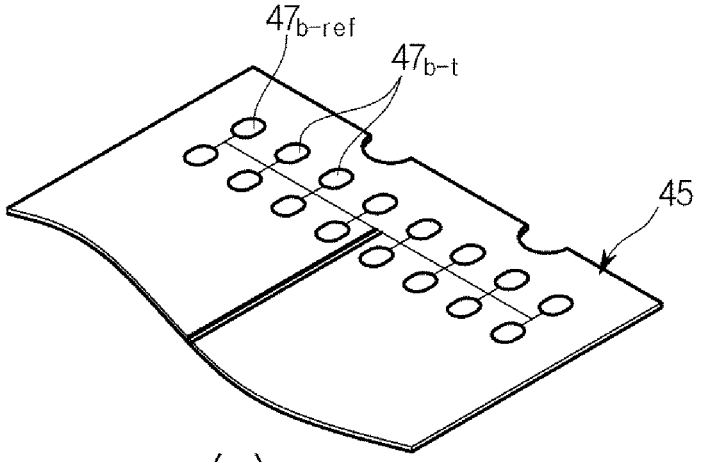
FIG. 13 is a view illustrating external appearances of testers of fluid analysis cartridges according to an exemplary embodiment and another exemplary embodiment.
Figure 13:
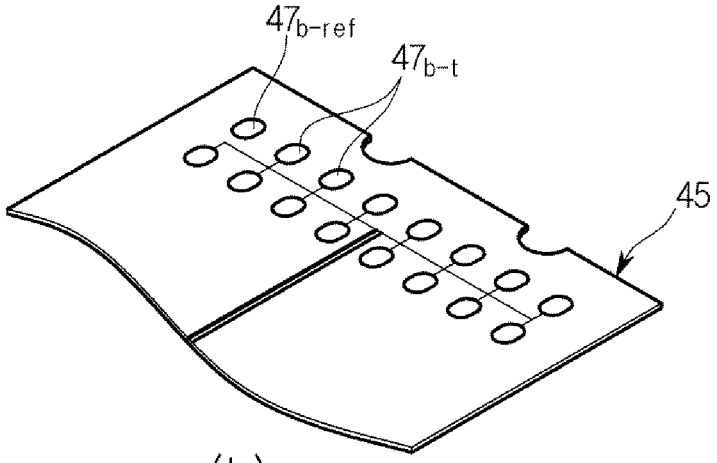

FIG. 13 is a view illustrating external appearances of testers of a fluid analysis cartridge according to an exemplary embodiment and another exemplary embodiment.

Referring to (a) of FIG. 13, a test portion $\mathbf{47}_{b\text{-}ref}$ of a reference well $W_{ref}$ according to an exemplary embodiment may be connected to test portions $\mathbf{47}_{b\text{-}t}$ of other test wells $W_t$ so a fluid sample may flow into the test portion $\mathbf{47}_{b\text{-}ref}$ of the reference well $W_{ref}$. In this case, the macromolecular coloring reagent 49 of the reference well $W_{ref}$ may include macromolecular material which barely reacts to the fluid sample and is sensitive to the thickness d of the test portion $\mathbf{47}_{b\text{-}ref}$ only.

Meanwhile, referring to (b) of FIG. 13, a test portion $\mathbf{47}_{b\text{-}ref}$ of a reference well $W_{ref}$ according to another exemplary embodiment may be disconnected from test portions $\mathbf{47}_{b\text{-}t}$ of other test wells $W_t$. In this case, although a fluid sample flows into the test portions 47*b-t* of the other test wells $W_t$, the reference well $W_{ref}$ may not react with the fluid sample as well.

When the fluid analysis cartridge 40 according to one of the exemplary embodiments is inserted into the mounting member 32 shown in FIG. 1 of the fluid analysis apparatus 1, the fluid analysis apparatus 1 may measure the light absorbance of the reference well $W_{ref}$ and the light absorbance of the test well $W_t$ and may correct the light absorbance of the test well $W_t$ based on the thickness information of the reference well $W_{ref}$. Then, the fluid analysis apparatus 1 may display an analyzed result on the display 21 shown in FIG. 1 based on the corrected light absorbance of each test well $W_t$.

Further, when the fluid analysis cartridge 40 includes the tag QR according to another exemplary embodiment, the fluid analysis apparatus 1 may read the tag QR of the fluid analysis cartridge 40 and correct the light absorbance of the test wells $W_t$ after deciding which data among the various pieces of thickness sensitivity data should be used to perform calibration.

Figure 14:
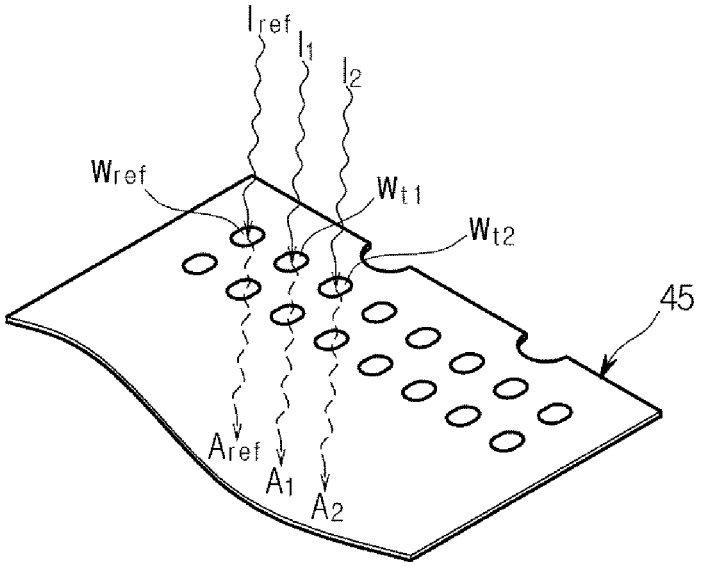
FIG. 14 is a view for describing a method of a fluid analysis apparatus measuring a light absorbance of a reference well and a light absorbance of a test well.
Figure 15:
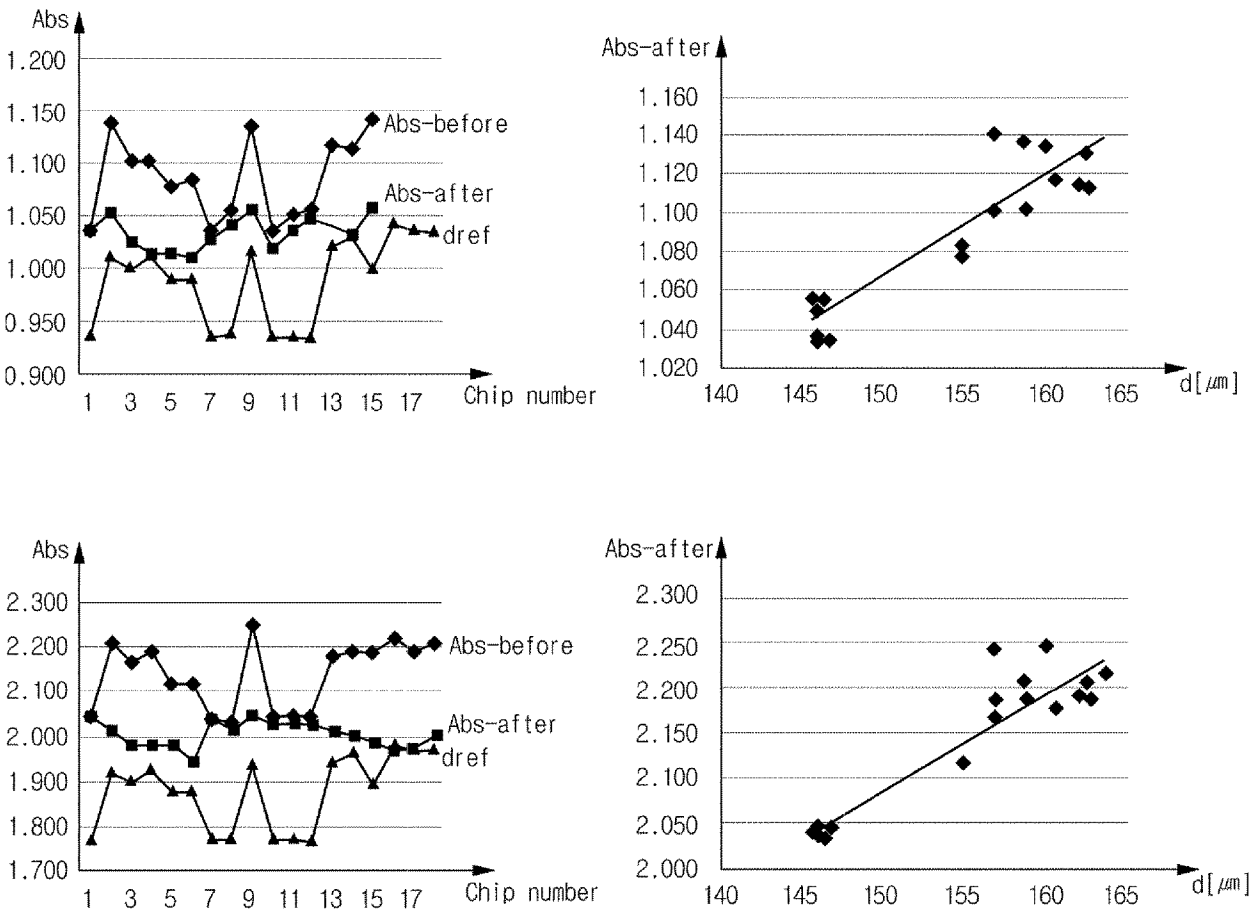
FIG. 15 is an experimental example showing light absorbance of test wells obtained before and after the correction.

FIG. 14 is a view for describing a measuring method to measure, by a fluid analysis apparatus, a light absorbance of a reference well and a test well, and FIG. 15 is an experimental example showing light absorbance of test wells obtained before and after the correction.

Referring to FIG. 14, the fluid analysis apparatus 1 may further include a light absorbance analyzing module configured to quantify color shown from each test portion 47*b* of the reference well $W_{ref}$ and the test well $W_t$ by measuring the color optically and generate light absorbance data based on the quantified color. The fluid analysis apparatus 1 may further include a controller configured to determine the thickness of the reference well $W_{ref}$ based on the generated light absorbance data.

The light absorbance analyzing module may include a light source configured to transmit light $I_{ref}$, $I_1$ and $I_2$ to test portions 47*b* of the reference well $W_{ref}$ and the test wells $W_{t1}$ and $W_{wt2}$, and a light detector configured to detect the light absorbance $A_{ref}$, $A_1$, $A_2$ of each test portion 47*b* by detecting the color, the wavelength of light passing through the test portions 47*b* of the reference well $W_{ref}$ and the test wells $W_{t1}$ and $W_{wt2}$, or the amount of light penetration (that is, the amount of light absorption) in a certain range of radiation wavelengths of light.

The controller of the fluid analysis apparatus 1 may measure the thickness d of the reference well $W_{ref}$ according to the Lambert-Beer law based on the light absorbance $A_{ref}$ of the reference well $W_{ref}$ and a pre-stored optical density of the reference well $W_{ref}$.

The controller of the fluid analysis apparatus 1 may measure the ratio of the measured thickness d of the reference well $W_{ref}$ to the light absorbance of the test well $W_t$, and may determine the measured ratio as a corrected light absorbance, that is, the optical density of the test well $W_t$ according to the Lambert-Beer law.

The controller may include a memory which stores data necessary to operate the fluid analysis apparatus 1, for example, the optical density of the reference well $W_{ref}$ and a program to measure the ratio of the thickness of the reference well $W_{ref}$, and a processor configured to control each element of the fluid analysis apparatus 1 according to the stored program.

Referring to FIG. 15, "Abs-before" represents the light absorbance detected from a cholesterol detecting well (CHOL) included in a plurality of the testers 45 filled with the same fluid samples, "dref" represents the thickness of the reference well $W_{ref}$, and "Abs-after" represents the light absorbance of the cholesterol detecting well (CHOL) after the correction.

As a result of experiment, the light absorbance after the correction (Abs-after) is shown as relatively uniform regardless of the chip number of the tester 45 due to the correction. Further, the light absorbance after the correction (Abs-after) is shown as linear with respect to the thickness d of the reference well $W_{ref}$.

The identical characteristics may be shown with respect to a glucose detecting well (GLU) and descriptions about same elements or function with the cholesterol detecting well (CHOL) is omitted.

As is apparent from the above, the fluid analysis cartridge accommodates a macromolecular coloring reagent, and the fluid analysis cartridge can determine the thickness of a well included in the fluid analysis cartridge based on the optical characteristics of a coloring sample.

Since the fluid analysis cartridge accommodates a macromolecular coloring reagent, a reference well can be less affected by a fluid sample flowing into the reference well, so that the fluid analysis apparatus can estimate the thickness d of the reference well regardless of inflow of the fluid sample.

Further, the fluid analysis apparatus according to another aspect of exemplary embodiments may correct the light absorbance of the fluid sample accurately based on the determined thickness of the reference well $W_{ref}$.

Exemplary embodiments of the present disclosure have been described above. In the exemplary embodiments described above, some components may be implemented as a "module". Here, the term 'module' may refer to, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more CPUs in a device.

While exemplary embodiments have been described with respect to a limited number of exemplary embodiments, those skilled in the art, having the benefit of this disclosure, will appreciate that other exemplary embodiments can be devised which do not depart from the scope as disclosed herein. Accordingly, the scope should be limited only by the attached claims.

What is claimed is:

1. A fluid analysis cartridge comprising:

a first sheet comprising at least one area to which light is irradiated, a second sheet comprising:

a reference well comprising a macromolecular coloring reagent having an optical characteristic that varies according to a thickness of the reference well; and a test well comprising a test reagent having an optical characteristic that varies according to each of a thickness of the test well and a concentration of a component of a fluid sample that reacts with the test reagent, a third sheet, wherein the first sheet is attached to a first side of the second sheet and the third sheet is attached to a second side of the second sheet, wherein the light passes from the second sheet toward the third sheet, wherein the macromolecular coloring reagent is accommodated in an area of the second sheet corresponding to the reference well, and wherein the test reagent for testing the fluid sample is accommodated in another area of the second sheet corresponding to the test well.

2. The fluid analysis cartridge according to claim 1, wherein the optical characteristic of the macromolecular coloring reagent includes a light absorbance.

3. The fluid analysis cartridge according to claim 1, wherein the macromolecular coloring reagent includes macromolecular material and a coloring reagent which has sensitivity to the thickness of the reference well, wherein sensitivity to the thickness of the reference well is determined based on an absorbance variation of the coloring reagent.

4. The fluid analysis cartridge according to claim 3, wherein the macromolecular material includes at least one selected from the group consisting of phenyl vinyl ketone (PVK) and poly vinyl chloride (PVC).

5. The fluid analysis cartridge according to claim 3, wherein the coloring reagent includes at least one selected from the group consisting of pyrene, acridine, methylene blue, acridine-orange, texas red, cyanine, and azo compound, the cyanine including cy3 and cy5.

6. The fluid analysis cartridge according to claim 1, further comprising a tag including information about at least one of a component and a concentration of the macromolecular coloring reagent comprised in the reference well.

7. The fluid analysis cartridge according to claim 6, wherein the tag includes at least one of a Quick Response (QR) code, a bar code, and a radio frequency identification (RFID) tag.

8. The fluid analysis cartridge according to claim 6, further comprising a holder configured to support the fluid analysis cartridge.

9. The fluid analysis cartridge according to claim 8, wherein the tag is installed on a rear side of the holder, the rear side being opposite to a side at which the fluid sample is supplied to the test well.

10. The fluid analysis cartridge according to claim 1, wherein the first sheet and the third sheet are formed of the same material, wherein the first sheet, the second sheet and third sheet are bonded to each other.

11. The fluid analysis cartridge according to claim 10, wherein an area of the first sheet corresponding to the reference well and another area of the first sheet corresponding to the test well are transparent.

12. The fluid analysis cartridge according to claim 10, wherein the first sheet and the third sheet each includes at least one of a polyethylene (PE) film, a polypropylene (PP) film, a polyvinyl chloride (PVC) film, a polyvinyl alcohol (PVA) film, a polystyrene (PS) film, a polyethylene terephthalate (PET) film, and a urethane film, wherein the PE film includes at least one of Very Low Density Polyethylene (VLDPE), Linear Low Density Polyethylene (LLDPE), Low Density Polyethylene (LDPE), Medium Density Polyethylene (MDPE), and High Density Polyethylene (HDPE).

13. The fluid analysis cartridge according to claim 10, wherein the second sheet is a porous sheet.

14. The fluid analysis cartridge according to claim 10, wherein the second sheet includes at least one of cellulose acetate, Nylon 6.6, Nylon 6.10, polyethersulfone, poly tetrafluoro ethylene (PTFE), poly vinylidene fluoride (PVDF), and polyurethane.

15. A fluid analysis apparatus comprising:

a fluid analysis cartridge configured to accommodate a fluid sample;

a mounting member configured to mount the fluid analysis cartridge mounted to the fluid analysis apparatus;

a light source configured to emit a light toward the fluid analysis cartridge;

a light detector configured to detect the light emitted from the light source; and a processor configured to generate a data based on the detected light, wherein the fluid analysis cartridge comprises:

a first sheet comprising at least one area to which light is irradiated, a second sheet comprising:

a reference well comprising a macromolecular coloring reagent having an optical characteristic that varies according to a thickness of the reference well, and a test well comprising a test reagent having an optical characteristic that varies according to each of a thickness of the test well and a concentration of a component included in the fluid sample that reacts with the test reagent, and a third sheet, wherein the first sheet is attached to a first side of the second sheet and the third sheet is attached to a second side of the second sheet, wherein the light passes from the second sheet toward the third sheet, and wherein the processor is further configured to change a test result of the test well based on a data of the reference well.

16. The fluid analysis apparatus according to claim 15, further comprising a light absorbance analysis module configured to measure a light absorbance of the reference well and a light absorbance of the test well when light is transmitted through the reference well and the test well.

17. The fluid analysis apparatus according to claim 16, further comprising a controller configured to determine the thickness of the reference well based on the light absorbance of the reference well.

18. The fluid analysis apparatus according to claim 17, wherein the controller is further configured to correct the light absorbance of the test well based on the determined thickness of the reference well.

19. The fluid analysis apparatus according to claim 15, wherein the macromolecular coloring reagent includes macromolecular material and a coloring reagent which has sensitivity to the thickness of the reference well, wherein sensitivity to the thickness of the reference well is determined based on an absorbance variation of the coloring reagent.

* * * * *